US010500603B2

(12) United States Patent
Byrne et al.

(10) Patent No.: US 10,500,603 B2
(45) Date of Patent: Dec. 10, 2019

(54) ROLLER COVER AND ASSOCIATED CAMS

(71) Applicant: The Wooster Brush Company, Wooster, OH (US)

(72) Inventors: James M. Byrne, Wooster, OH (US); Richard K. Bukovitz, Orrville, OH (US); Lawrence A. Schwartz, Bay City, MI (US)

(73) Assignee: The Wooster Brush Company, Wooster, OH (US)

( * ) Notice: Subject to any disclaimer, the term of this patent is extended or adjusted under 35 U.S.C. 154(b) by 0 days.

(21) Appl. No.: 15/878,798

(22) Filed: Jan. 24, 2018

(65) Prior Publication Data

US 2018/0161800 A1 Jun. 14, 2018

Related U.S. Application Data

(62) Division of application No. 14/467,403, filed on Aug. 25, 2014, now Pat. No. 9,884,339.

(60) Provisional application No. 61/872,195, filed on Aug. 30, 2013.

(51) Int. Cl.
*B05C 17/02* (2006.01)
*B05C 1/08* (2006.01)

(52) U.S. Cl.
CPC ..... *B05C 1/0895* (2013.01); *B05C 17/02* (2013.01); *B05C 17/021* (2013.01); *B05C 17/0245* (2013.01); *B05C 17/0207* (2013.01); *B05C 17/0225* (2013.01); *B05C 17/0242* (2013.01)

(58) Field of Classification Search
None
See application file for complete search history.

(56) References Cited

U.S. PATENT DOCUMENTS

| | | | | |
|---|---|---|---|---|
| 2,644,186 | A * | 7/1953 | Guimond | B05C 17/02 15/166 |
| 2,663,892 | A | 12/1953 | Schaefer | |
| 2,763,022 | A * | 9/1956 | Glacken | B05C 17/02 15/230.11 |
| 2,891,301 | A * | 6/1959 | Conklin | B05C 17/02 492/13 |
| 3,204,276 | A * | 9/1965 | Kennedy, Sr. | B05C 17/0225 15/118 |
| 3,685,084 | A | 8/1972 | Bennett | |
| 4,599,762 | A | 7/1986 | Rigter | |
| 5,133,117 | A | 7/1992 | Lomasney | |
| 5,606,763 | A | 3/1997 | South et al. | |
| 6,308,370 | B1 | 10/2001 | Southby | |
| 6,347,426 | B1 * | 2/2002 | Weiss | B05C 17/02 15/230.11 |

(Continued)

FOREIGN PATENT DOCUMENTS

EP 0765693 2/1997

*Primary Examiner* — Binu Thomas
(74) *Attorney, Agent, or Firm* — Renner, Otto, Boisselle & Sklar, LLP

(57) ABSTRACT

A roller cover and associated pair of cams attachable to opposite ends of the roller cover. Each of the cams has an outer diameter extending radially outwardly beyond an outer diameter of the roller cover a predetermined distance for maintaining the outer diameter of the roller cover a corresponding distance from the surface being coated during rotational movement of the roller cover over the surface to act as a thickness gauge for the coating being applied to the surface.

9 Claims, 2 Drawing Sheets

(56) References Cited

U.S. PATENT DOCUMENTS

| | | | | |
|---|---|---|---|---|
| 6,510,579 | B1 * | 1/2003 | Gartner | B05C 17/02 15/230.11 |
| 2002/0042331 | A1 | 4/2002 | Fortner | |
| 2012/0233893 | A1 * | 9/2012 | Poole | G01B 3/04 40/299.01 |
| 2013/0340192 | A1 * | 12/2013 | DeCarr | B05C 17/0225 15/230.11 |

* cited by examiner

ROLLER COVER AND ASSOCIATED CAMS

CROSS-REFERENCE TO RELATED APPLICATION

This application is a divisional of U.S. patent application Ser. No. 14/467,403 filed Aug. 25, 2014, which claims the benefit of U.S. Provisional Application Ser. No. 61/872,195, filed Aug. 30, 2013, the entire disclosures of which are incorporated herein by reference.

FIELD OF THE INVENTION

This invention related generally to a roller cover and associated cams that act as a thickness gauge for a spreadable coating when applied to a surface using the roller cover.

BACKGROUND

There are quite a few different known types of devices including roller covers that are useful in applying a substantially uniform thickness of a spreadable polymer coating such as an epoxy or other type polymer to surfaces of various types including countertops and floors and the like.

However, there is an ongoing need for a device that can be used more effectively to apply spreadable coatings of a desired thickness to countertops and floorings of different types.

SUMMARY OF THE INVENTION

In accordance with one aspect of the invention, different diameter cams may be attached to opposite ends of a roller cover for maintaining the outer diameter of the roller cover a predetermined distance from a surface to which a spreadable coating is to be applied during rotational movement of the roller cover over the surface to act as a thickness gauge for the coating being applied to the surface.

In accordance with another aspect of the invention, each of the cams has a bearing support for rotatably supporting opposite ends of the roller cover on a shaft portion of a roller frame.

In accordance with another aspect of the invention, the outer diameter of each of the cams has an outer peripheral edge containing a plurality of circumferentially spaced notches to reduce the amount of surface contact of the cams with the surface being coated during rotational movement of the roller cover over the surface.

In accordance with another aspect of the invention, different pairs of the cams having different outer diameters all greater than the outer diameter of the outer covering of the roller cover may be interchangeable to provide different thickness gauges for the coating to be applied to the surface during rotational movement of the roller cover over the surface.

In accordance with another aspect of the invention, the different diameter pairs of cams may be color coded to indicate different coating thicknesses the different diameter pairs of cams will leave on the surface during rotational movement of the roller cover over the surface.

These and other objects, advantages, features and aspects of the present invention will become apparent as the following description proceeds.

DETAILED DESCRIPTION

Figure 1:
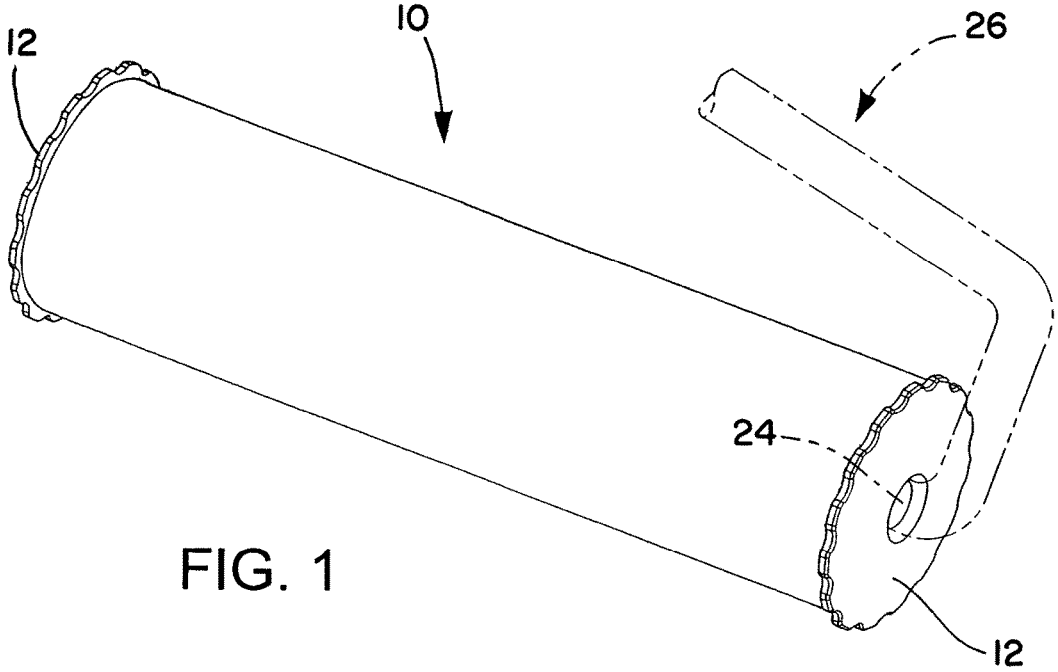
FIG. 1 is a schematic perspective view of an exemplary roller cover and associated cams shown mounted on the shaft portion of a paint roller frame.
Figure 2:
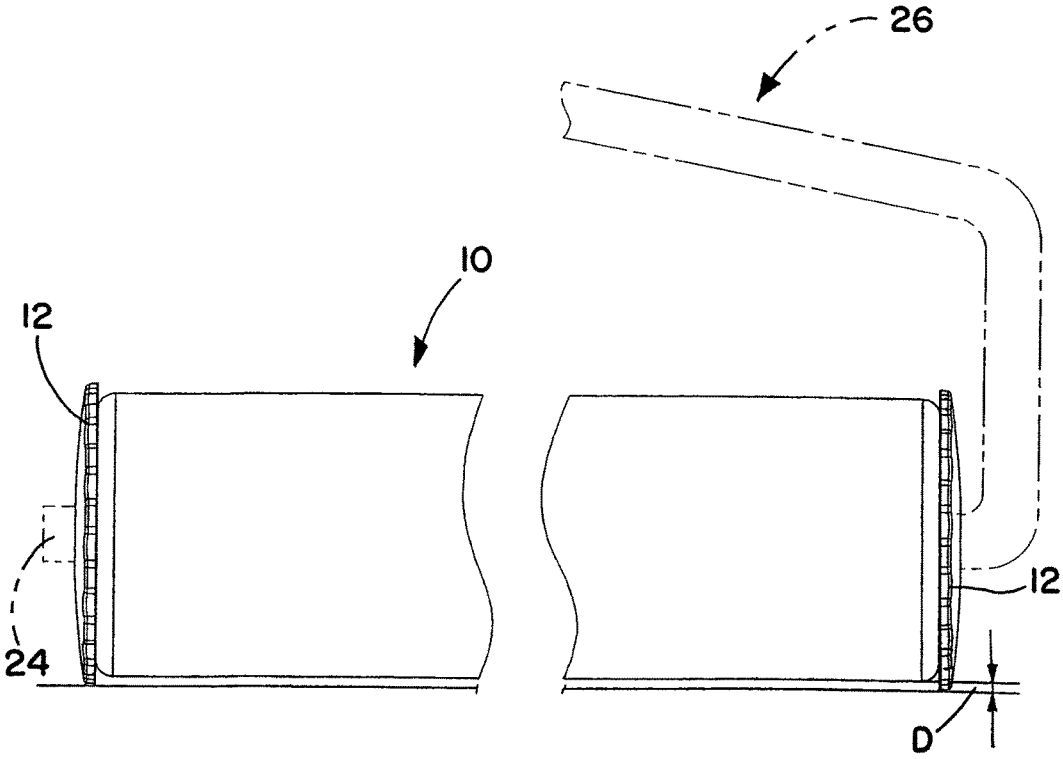
FIG. 2 is an enlarged fragmentary side elevation view of the roller cover and associated cams of FIG. 1.
Figure 4:
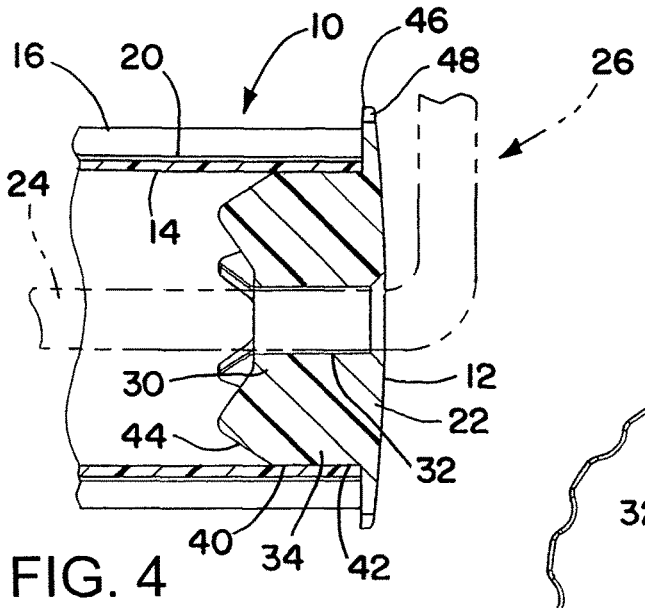
FIG. 4 is a fragmentary longitudinal section through the right end of the roller cover and associated cam of FIG. 3 taken on the plane of the line 4-4 thereof.
Figure 3:
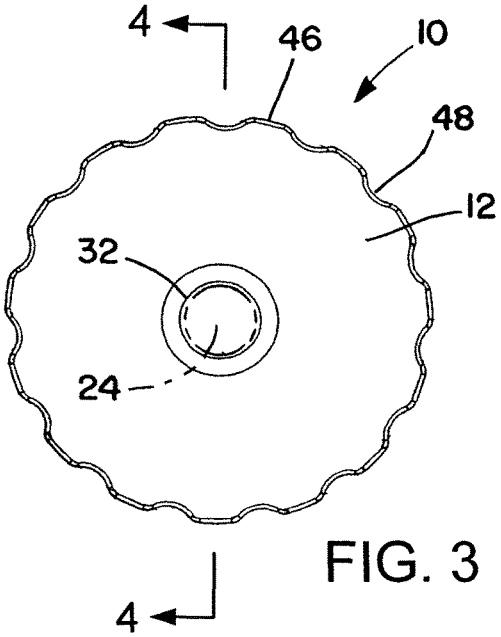
FIG. 3 is an enlarged right end view of the roller cover and associated cam of FIG. 2.

Referring now in detail to the drawings, and initially to FIGS. 1-4, there is shown an exemplary embodiment of a roller cover 10 and associated pair of cams 12 of the present invention attached to opposite ends of the roller cover. The cams act as a thickness gauge when the roller cover is used to apply a suitable spreadable polymer coating such as epoxy or other polymer of a desired thickness to surfaces of various types including but not limited to countertops and flooring as described hereafter.

The roller cover 10 may be of any suitable type. As seen in the non-limiting example shown in FIG. 4, the roller cover comprises a hollow tubular core 14 to which a suitable outer covering 16 is suitably secured. The core 14 may be made for example of any suitable crystalline or semi-crystalline polyolefin polymer such as natural and filled polypropylene and high density polyethylene. The outer covering 16 may be a conventional roller fabric having for example a heavy open weave thermoplastic backing woven into the fabric to allow for a superior mechanical bond between the fabric backing and a bonding film 20 used to adhere the outer covering to the core. The fabric pile or nap of the outer covering may be made of different materials or blends and of different heights depending on the particular application.

Figure 5:
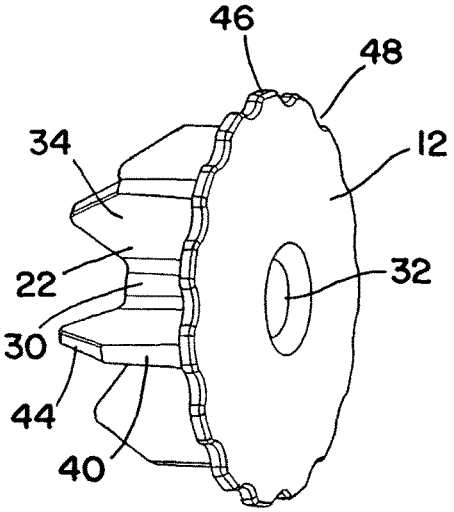
FIG. 5 is an enlarged perspective view of the cam of FIG. 4 as seen from the right end thereof.
Figure 7:
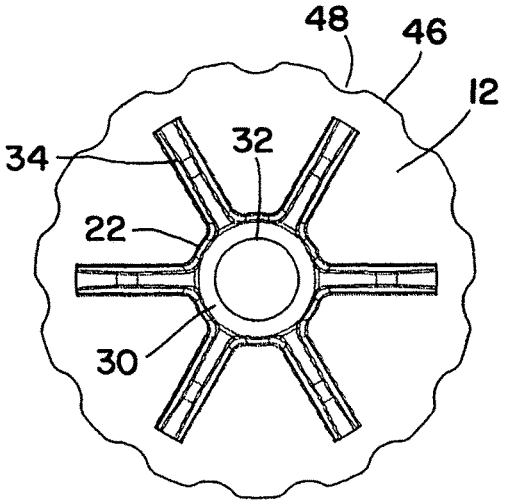
FIG. 7 is a left end view of the cam of FIG. 5.
Figure 6:
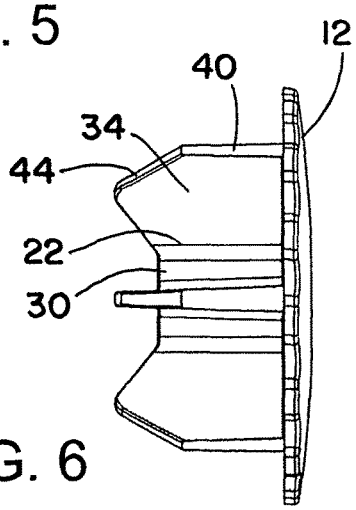
FIG. 6 is a side view of the cam of FIG. 5.

A pair of the cams 12 preferably of substantially the same size and shape may be attached to opposite ends of the roller cover 10 in any suitable manner. In the non-limiting example disclosed herein, each of the cams 12 has a bearing support 22 for rotatably supporting opposite ends of the roller cover 10 on a shaft portion 24 of a roller frame 26 (shown in phantom lines in FIGS. 1-4). As can be seen in FIGS. 4-7, the bearing support 22 of each of the cams comprises a central hub portion 30 containing an axial bore 32 for rotatably mounting the roller cover 10 and associated cams on the shaft portion 24 of the roller frame 26. Extending radially outwardly from the central hub portion of each of the cams are a plurality of circumferentially spaced ribs 34. Each of the ribs has an axially extending outer edge 40 that is frictionally engageable with the inner diameter of the opposite open ends 42 of the hollow core 14 for frictionally attaching the cams to the ends of the roller cover. Also the ribs may have radially and axially inwardly angled inner end portions 44 as shown for ease of insertion of the ribs into the opposite open ends of the hollow core.

When the pair of cams 12 are suitably attached to opposite ends of the roller cover 10, the outer diameter of each of the pair of cams 12 extends radially outwardly beyond the outer diameter of the outer covering 16 of the roller cover a predetermined distance D (see FIG. 2) for maintaining the outer diameter of the outer covering a corresponding distance from the surface being coated during rotational movement of the roller cover over the surface to act as a thickness gauge for the coating being applied to the surface.

In the exemplary embodiment disclosed herein, the outer diameter of each of the cams has an outer peripheral edge 46 containing a plurality of circumferentially spaced notches 48 to reduce the amount of surface contact of the outer diameter edge with the surface being coated during rotational movement of the roller cover over the surface. This has the advantage that the notched outer diameter edge of the cams will form relatively small dimples in the spreadable coating during rotational movement of the roller cover over the surface that will more readily fill in than if there were no notches in the outer diameter edge of the cams. Although the number and size of the notches may be varied as desired, there are preferably approximately ten to twenty substantially uniformly spaced notches in the outer diameter edge of the cams and more preferably approximately fifteen substantially uniformly spaced notches therein. Also each of the notches preferably has a radius of between approximately 0.10 inch and approximately 0.15 inch, and more preferably approximately 0.12 inch.

A plurality of different pairs of the cams 12 having different outer diameters all greater than the outer diameter of the outer covering of the roller cover may be interchangeable to provide different thickness gauges for the coating to be applied to the surface during rotational movement of the roller cover over the surface. Moreover, the different diameter pairs of cams may be color coded to indicate different coating thicknesses the respective pairs of different diameter cams will leave on the surface during rotational movement of the roller cover over the surface. By way of example, one pair of color coded roller cams (e.g., a yellow color coding) may have an outer radius of approximately four to six mils greater than the outer radius of the roller cover used to deposit a four to six mil coating layer on a surface; another pair of color coded roller cams (e.g., a green color coding) may have an outer radius of approximately fourteen to sixteen mils, greater than the outer radius of the roller cover used to deposit a fourteen to sixteen mil coating layer on a surface; and another pair of color coded roller cams (e.g., a red color coding) may have an outer radius of approximately twenty-four to twenty-six mils greater than the outer radius of the roller cover used to deposit a twenty-four to twenty-six mil layer coating on a surface.

Although the invention has been shown and described with respect to a certain embodiment, equivalent alterations and modifications will become apparent upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the exemplary embodiment. In addition, while a particular feature may have been disclosed with respect to only one embodiment, such feature may be combined with one or more other features as may be desired or advantageous for any given or particular application.

What is claimed is:

1. In combination, a plurality of pairs of roller cover cams for use in maintaining an outer diameter of a roller cover a predetermined distance from a surface to which a spreadable coating is to be applied by the roller cover during rotational movement of the roller cover over the surface to act as a thickness gauge for the coating being applied to the surface, each of the roller cover cams having an axially outer flange portion and an axially inner roller attachment portion for attaching the roller cover cams to opposite ends of the roller cover, and the axially outer flange portion of the roller cover cams having an outer diameter greater than the outer diameter of the roller cover a predetermined amount to act as a thickness gauge for the coating being applied to the surface during rotational movement of the roller cover over the surface, and the axially inner roller attachment portion having a radially outer surface for engaging a radially inner surface of the roller cover to preclude radial shifting of the roller cover cams relative to the roller cover, and wherein the plurality of pairs of the roller cover cams have different outer diameters all greater than the outer diameter of the outer covering of the roller cover and are interchangeable to provide different thickness gauges for the coating to be applied to the surface during rotational movement of the roller cover over the surface, thereby enabling a user to select from the plurality of pairs of roller cover cams a given pair to provide a corresponding thickness of the coating to be applied.

2. The combination of claim 1, wherein the outer diameter of the axially outer flange portion has an outer peripheral edge containing a plurality of circumferentially spaced notches to reduce the amount of surface contact of the roller cover cams with the surface being coated during rotational movement of the roller cover over the surface to which the coating is being applied.

3. Roller cover cams for use in maintaining an outer diameter of a roller cover a predetermined distance from a surface to which a spreadable coating is to be applied by the roller cover during rotational movement of the roller cover over the surface to act as a thickness gauge for the coating being applied to the surface, each of the roller cover cams having an axially outer flange portion and an axially inner roller attachment portion for attaching the roller cover cams to opposite ends of the roller cover, and the axially outer flange portion of the roller cover cams having an outer diameter greater than the outer diameter of the roller cover a predetermined amount to act as a thickness gauge for the coating being applied to the surface during rotational movement of the roller cover over the surface, and the axially inner roller attachment portion having a radially outer surface for engaging a radially inner surface of the roller cover to preclude radial shifting of the roller cover cams relative to the roller cover, wherein the outer diameter of the axially outer flange portion has an outer peripheral edge containing a plurality of circumferentially spaced notches to reduce the amount of surface contact of the roller cover cams with the surface being coated during rotational movement of the roller cover over the surface to which the coating is being applied, and wherein the circumferentially spaced notches of the plurality of circumferentially spaced notches have a radius of between approximately 0.10 inch and approximately 0.15 inch.

4. Roller cover cams for use in maintaining an outer diameter of a roller cover a predetermined distance from a surface to which a spreadable coating is to be applied by the roller cover during rotational movement of the roller cover over the surface to act as a thickness gauge for the coating being applied to the surface, each of the roller cover cams having an axially outer flange portion and an axially inner roller attachment portion for attaching the roller cover cams to opposite ends of the roller cover, and the axially outer flange portion of the roller cover cams having an outer diameter greater than the outer diameter of the roller cover a predetermined amount to act as a thickness gauge for the coating being applied to the surface during rotational movement of the roller cover over the surface, and the axially inner roller attachment portion having a radially outer surface for engaging a radially inner surface of the roller cover to preclude radial shifting of the roller cover cams relative to the roller cover, wherein the outer diameter of the axially outer flange portion has an outer peripheral edge containing a plurality of circumferentially spaced notches to reduce the amount of surface contact of the roller cover cams with the surface being coated during rotational movement of the roller cover over the surface to which the coating is being applied, and wherein there are 10 to 20 circumferentially spaced notches in the outer peripheral edge of the roller cover cams.

5. The combination of claim 1, wherein the pairs of roller cover cams having different diameters are color coded to indicate different coating thicknesses the respective pairs of different diameter roller cover cams will leave on the surface during rotational movement of the roller cover over the surface to which the coating is being applied.

6. The combination of claim 1, wherein each of the roller cover cams has a bearing support for rotatably supporting the opposite ends of the roller cover on a shaft portion of a roller frame.

7. The combination of claim 6, wherein the bearing support of each of the roller cover cams comprises a central hub portion extending axially inwardly from the respective roller cover cams for insertion into opposite open ends of roller cover, the central hub portion of each of the roller cover cams containing an axial bore for rotatably mounting the roller cover and associated roller cover cams on the shaft portion of the roller frame.

8. The combination of claim 7, wherein the central hub portion of each of the roller cover cams has a plurality of circumferentially spaced radially outwardly extending ribs forming the axially inner attachment portion, the circumferentially spaced radially outwardly extending ribs of the plurality of circumferentially spaced radially outwardly extending ribs having axially inwardly extending outer edges for frictionally engaging an inner diameter of the opposite open ends of the roller cover for frictionally attaching the roller cover cams to the opposite open ends of the roller cover.

9. The combination of claim 8, wherein the circumferentially spaced radially outwardly extending ribs of the plurality of circumferentially spaced radially outwardly extending ribs have radially and axially inwardly angled inner end portions for ease of insertion of the ribs into the opposite open ends of the roller cover.

* * * * *